US012005944B2

(12) United States Patent
Khalil et al.

(10) Patent No.: US 12,005,944 B2
(45) Date of Patent: Jun. 11, 2024

(54) METHOD AND DEVICE FOR DIAGNOSING A RAILROAD SWITCH WITH A POINT MACHINE

(71) Applicant: Siemens Mobility GmbH, Bayern (DE)

(72) Inventors: Mohamed Khalil, Munich (DE); Stefan Boschert, Neubiberg (DE); Ioannis Kouroudis, Munich (DE)

(73) Assignee: SIEMENS MOBILITY GMBH, Bayern (DE)

( * ) Notice: Subject to any disclaimer, the term of this patent is extended or adjusted under 35 U.S.C. 154(b) by 270 days.

(21) Appl. No.: 17/527,627

(22) Filed: Nov. 16, 2021

(65) Prior Publication Data

US 2022/0177016 A1 Jun. 9, 2022

(30) Foreign Application Priority Data

Dec. 4, 2020 (EP) ..... 20211984

(51) Int. Cl.
*B61L 27/53* (2022.01)
*B61L 1/02* (2006.01)
*B61L 23/04* (2006.01)

(52) U.S. Cl.
CPC ..... *B61L 27/53* (2022.01); *B61L 1/02* (2013.01)

(58) Field of Classification Search
CPC ..... B61L 27/53; B61L 27/57; B61L 23/042; B61L 23/04
See application file for complete search history.

(56) References Cited

U.S. PATENT DOCUMENTS

2010/0262321 A1* 10/2010 Daum ..... B61L 27/16 701/19
2013/0294937 A1* 11/2013 Worden ..... F04B 51/00 417/63

(Continued)

FOREIGN PATENT DOCUMENTS

CN 101893667 B 12/2012
CN 105260595 A 1/2016

(Continued)

OTHER PUBLICATIONS

Ion, Matei et al: "The Case for a Hybrid Approach to Diagnosis: A Railway Switch"; Proceedings of the 26th International Workshop on Principles of Diagnosis; Aug. 2015; pp. 225-233; XP055632016; 2015.

(Continued)

*Primary Examiner* — Jermele M Hollington
*Assistant Examiner* — Temilade S Rhodes-Vivour
(74) *Attorney, Agent, or Firm* — Schmeiser, Olsen & Watts LLP

(57) ABSTRACT

For diagnosing a railroad switch with a point machine, a first and a second time series of a sensor signal of the point machine are received. Moreover, changes in the first and the second time series are detected indicating changes of operational conditions of the point machine. Furthermore, an event point of a respective change in the first and in the second time series is allocated to a respective component of the railroad switch or of the point machine based on a simulation modelling the respective component. Then for a respective component: event points allocated to that respective component are identified, the sensor signal at a first identified event point in the first time series is compared with the sensor signal at a second identified event point in the second time series, and depending on the comparison a (Continued)

component-specific fault information and an identification of the respective component are output.

11 Claims, 3 Drawing Sheets

(56) References Cited

U.S. PATENT DOCUMENTS

| | | | | |
|---|---|---|---|---|
| 2015/0158511 | A1* | 6/2015 | Fries | B61L 27/53 324/511 |
| 2017/0309093 | A1* | 10/2017 | Feng | B60W 10/10 |
| 2019/0300030 | A1 | 10/2019 | Heinrich et al. | |
| 2021/0065065 | A1* | 3/2021 | Matei | G06N 7/01 |
| 2021/0081511 | A1* | 3/2021 | Matei | G06F 17/13 |

FOREIGN PATENT DOCUMENTS

| | | | |
|---|---|---|---|
| DE | 102016221479 | A1 | 5/2018 |
| WO | WO 2016074971 | A1 | 5/2016 |
| WO | WO 2018082857 | A1 | 5/2018 |

OTHER PUBLICATIONS

Atamuradov, V. et al: "Fai lure diagnostics for railway point machines using expert systems"; Diagnostics for Electric Machines, Power Electronics and Drives; 2009; SDEMPED 2009; IEEE International Symposium On; IEEE; Piscataway; NJ; USA; Aug. 31, 2009; pp. 1-5; XP031550273; ISBN: 978-1-4244-3441-1; 2009.

* cited by examiner

METHOD AND DEVICE FOR DIAGNOSING A RAILROAD SWITCH WITH A POINT MACHINE

CROSS-REFERENCE TO RELATED APPLICATIONS

This application claims priority to European Application No. 20211984.8, having a filing date of Dec. 4, 2020, the entire contents of which are hereby incorporated by reference.

FIELD OF TECHNOLOGY

The following relates to a method and device for diagnosing a railroad switch with a point machine.

BACKGROUND

Railroad switches and their point machines are crucial components of a railroad infrastructure. They are usually operated up to hundreds of times a day and are essential to keep a railway network in operation. Typically, they are installed unprotected in an outdoor environment and contain parts moving constantly relative to other parts. Thus, switches and point machines are often subject to unforeseeable loads due to environmental factors and gradual degradation of their subcomponents. In case of malfunctions, however, the operation of a railway network can be severely impaired.

It is therefore desirable to monitor a health condition and/or to detect malfunctions of switches or point machines as precisely and specifically as possible.

To achieve this objective, several approaches are known:

In many cases human experts infer a health condition from personal inspections or from evaluating sensor signals of the point machine. There are also commercial diagnosis systems which support an expert with the evaluation of sensor signals, or which automatically evaluate such sensor signals. It is particularly known to process sensor signals in order to measure a deviation between current sensor signals and historic sensor signals. Significant deviations may be indicative of an abnormal behavior or malfunction. The above approaches, however, are often time consuming or not very specific. Other approaches comprise the application of data driven machine learning methods. These methods, however, usually need huge amounts of training data before reliable predictions can be made.

The above approaches or similar approaches are also disclosed in the publications DE102016221479A1, WO2018082857A1, WO2016074971A1, CN105260595A, and CN101893667B.

SUMMARY

An aspect relates to a method and a device for diagnosing a railroad switch with a point machine, that allow for a more specific diagnosis.

For diagnosing a railroad switch with a point machine, a first and a second time series of a sensor signal of the point machine are received, the sensor signal being sensitive to an operation of the point machine. Moreover, changes in the first and the second time series are detected indicating changes of operational conditions of the point machine. According to embodiments of the invention, an event point of a respective change in the first and in the second time series is allocated to a respective component of the railroad switch or of the point machine based on a simulation modelling the respective component. Then for a respective component:

- event points allocated to that respective component are identified,
- the sensor signal at a first identified event point in the first time series is compared with the sensor signal at a second identified event point in the second time series, and
- depending on the comparison a component-specific fault information and an identification of the respective component are output.

For performing the inventive method, a device, a computer program product (non-transitory computer readable storage medium having instructions, which when executed by a processor, perform actions), and a non-transient computer readable storage medium are provided.

The inventive method and/or the inventive device may be implemented by one or more processors, computers, application specific integrated circuits (ASIC), digital signal processors (DSP), programmable logic controllers (PLC), and/or field-programmable gate arrays (FPGA).

Embodiments of the invention allow for an efficient component-specific diagnosis of a railroad switch with a point machine. In many cases, a fault, damage or degradation can be correctly attributed to a causative component. Embodiments of the invention relay on sensor signals of the point machine without requiring a pre-trained data driven model or huge amounts of training data. Hence, embodiments of the invention may be robustly applied to different point machines or railroad switches with significantly less preparation effort than data driven approaches.

Particular embodiments of the invention are specified by the dependent claims. According to an advantageous embodiment of the invention, the sensor signal may specify a drive current or a power consumption of the point machine. In particular, a drive current or a power consumption of a motor of the point machine may be used. Such drive currents or power consumptions turn out to be reliable measures for forces, e.g., frictional forces occurring during operation of a drive.

According to a further embodiment of the invention, an operation of a respective component and a corresponding time series of the sensor signal may be simulated by the simulation. For different components the corresponding time series may be searched for component-individual patterns. From a respective component-individual pattern a characteristic event point may then be selected and allocated to the respective component. In particular, the occurring patterns may be correlated with operations of different components. Then a respective pattern may be allocated to a component which shows a highest or a particularly high correlation. Similarly, a characteristic event point may also be selected based on a correlation with the components. In particular, a random tree method may be used to implement the allocations.

According to a further embodiment of the invention, a mismatch, in particular a difference between the sensor signal at the first identified event point and the sensor signal at the second identified event point may be quantified. From the quantified mismatch a quantified fault information may be derived and output.

The quantified mismatch may be compared with a first predetermined threshold to determine whether the respective component is damaged or not. Furthermore, the quantified mismatch may be compared with a second predetermined threshold to determine whether a degradation of the respective component is gradual or sudden. Moreover, from the quantified mismatch a severity of a damage, a root cause of the damage, a failure mode, a degradation, and/or a remaining useful lifetime of the respective component may be determined.

Usually, a damage, a fault, a degradation, a failure, or a wear is expected to be the more serious the larger the quantified mismatch is. Hence, the quantified mismatch may be used as valuable quantitative measure for assessing a damage, a fault, a degradation, a failure, a health condition, and/or a remaining useful lifetime of the railroad switch or the point machine.

According to a further embodiment of the invention a dynamic time warping method may be used to quantify a measure of a similarity between the first time series and the second time series. From the quantified similarity measure a quantified fault information may be derived and output. The known dynamic time warping method allows to efficiently measure a similarity between two sequences which may vary in speed and scale. For applying such a dynamic time warping method, many efficient implementations of that method are available.

The quantified similarity measure may be compared with a third predetermined threshold to determine whether the railroad switch or the point machine is damaged or not. Furthermore, the quantified similarity measure may be compared with a fourth predetermined threshold to determine whether a degradation of the railroad switch or the point machine is gradual or sudden. Moreover, from the quantified similarity measure a severity of a damage, a root cause of the damage, a failure mode, a degradation, and/or a remaining useful lifetime of the railroad switch or the point machine may be determined. Like the quantified mismatch above, the quantified similarity measure may be used as valuable quantitative measure for assessing a damage, a fault, a degradation, a failure, a health condition, and/or a remaining useful lifetime of the railroad switch or the point machine.

According to a further embodiment of the invention, the second time series may be regularly taken from a current operation of the point machine whereas the first time series may be taken from a fault-free and/or historic operation period of the point machine, and/or from an operation immediately preceding the current operation. In particular, the first time series may be taken from a data base with historic operational data of the point machine or the railroad switch.

If a wear is caused by slow degradation, the second time series from current operation may be compared with a first time series from a historic operation period in order to recognize a deviation or difference. To recognize, on the other hand, a sudden event, such as a crack or external contamination, the second time series from current operation may be compared with a first time series from an immediately preceding operation.

BRIEF DESCRIPTION

Some of the embodiments will be described in detail, with references to the following Figures, wherein like designations denote like members, wherein.

DETAILED DESCRIPTION

Figure 1:
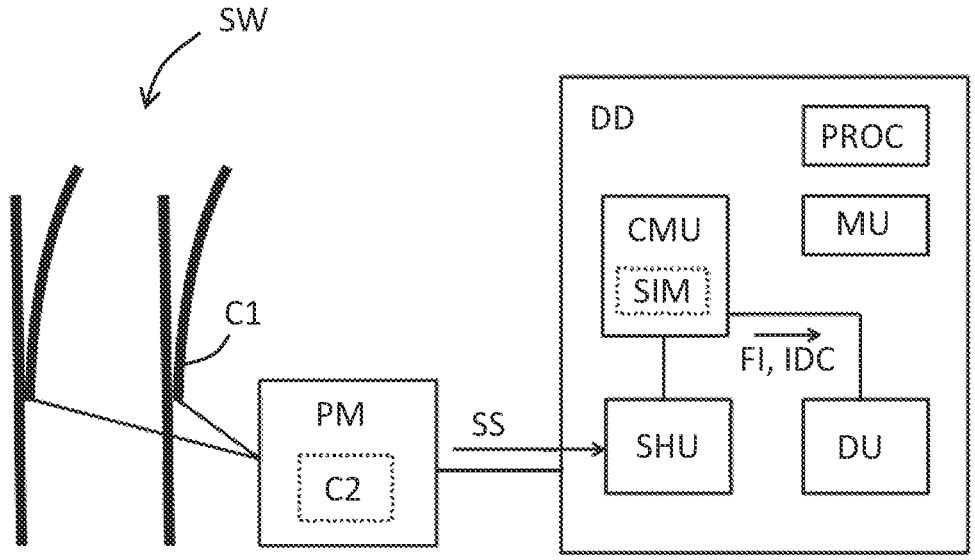
FIG. 1 shows an inventive device diagnosing a railroad switch with a point machine.

FIG. 1 shows an inventive device DD for diagnosing a railroad switch SW and a point machine PM in schematic representation. The railroad switch SW is operated and driven by the point machine PM.

The railroad switch SW comprises several specific components like a shift plate, operating rods, a point blade, a point lock, and various other parts. The point machine PM, on the other hand, comprises components like a drive motor, a spindle, a coupling, and several other parts. For the sake of clarity only one component C1 of the railroad switch SW and one component C2 of the point machine PM are exemplary indicated in FIG. 1.

The point machine PM is coupled to the diagnostic device DD and transmits sensor signals SS of the point machine PM to the diagnostic device DD. The sensor signals SS are sensitive to an operation of the point machine PM and may originate or be derived from sensors measuring operational quantities of the point machine PM or the railroad switch SW.

According to the present embodiment, the sensor signal SS specifies a drive current and/or a power consumption of the point machine PM. The drive current and/or the power consumption are continuously measured by appropriate sensors of the point machine PM. Measuring a drive current and/or a power consumption is a common method to determine forces which occur during operation of a drive. In this way an increased friction or obstructions of the railroad switch SW or the point machine PM can be detected and quantified.

The sensor signals are fed into a signal handling unit SHU of the diagnostic device DD. The signal handling unit SHU is designed to receive the sensor signal SS and to process it. In particular, noise and outliers may be removed using machine learning or other signal-processing methods. Furthermore, relevant features or patterns of the sensor signal SS, e.g., significant peaks, statistical quantities, symmetry, or similarity information, may be recognized and extracted by the signal handling unit SHU.

The processed sensor signal SS is transmitted from the signal handling unit SHU to a condition monitoring unit CMU of the diagnostic device DD. The condition monitoring unit CMU is designed to evaluate the processed sensor signal SS in order to determine a fault or a health condition of a respective component. Such an evaluation may e.g., comprise the following steps:

- The point machine PM may be checked whether its operation mode is correct or faulty. This may be particularly achieved by checking a value of the sensor signal SS corresponding to a start of a drive operation. This usually indicates a specific health status of the drive. Furthermore, a termination value of the sensor signal SS may be checked. After a blade of the railroad switch SW has moved from one side to the other, the drive current should drop to zero or almost zero. If the value is significantly higher, an incorrect termination of that operation and a fault of an involved component is indicated.
- Friction forces at both blades and a shift plate of the railroad switch SW may be inferred from the sensor signal SS. This may be particularly achieved by comparing one or more values and/or a form of a current sensor signal SS to historic sensor signals and/or to a baseline signal recorded at a very first operation phase. The baseline signal may be updated after a maintenance activity has been carried out. The above comparisons allow to determine the specific friction forces of the blades and the shift plate, thus indicating which component may be damaged, to what extent, and how long the point machine PM could stay in operation.

Having estimated friction forces on different blades and the shift plate, and having identified or located a faulty component, the lifetime of the point machine PM may be forecasted based on a rate of degradation it has experienced in the past.

Furthermore, by comparing the sensor signal SS with one or more previous sensor signals, it may be determined whether a degradation of a component is sudden or gradual.

Moreover, if a failure mode is identified, a maintenance proposal may be generated by the condition monitoring unit CMU.

For providing component-individual patterns of the sensor signal SS the condition monitoring unit CMU uses a simulation SIM, which models several components of the point machine PM and the railroad switch SW. The simulation SIM particularly models an operation of these components and an effect of a respective operation on the sensor signal SS. The condition monitoring unit CMU may carry out the simulation by itself and/or may access a data base with simulation data regarding these components.

The diagnostic device DD further comprises a processor PROC for executing the method steps of the diagnostic device DD and a memory unit MU for storing data to be processed. The memory unit MU particularly stores information needed or being useful for the evaluation of a component-specific fault or health condition. That information may e.g., comprise:

Properties of the point machine PM, e.g., its dimensions, its power rating, an upper limit of tolerable friction, or other factory settings.

A history of sensor signals or baseline signals for determining a friction of the rail blades or the shift plate.

A log containing historic faults and/or health conditions of the point machine PM or the railroad switch SW.

The currently measured, received and/or processed sensor signal SS. The latter may be updated each time an evaluation of a health condition or a fault is executed.

In particular, the memory unit MU may comprise a data base containing component-specific simulation data.

Based on the evaluation of the sensor signal SS the condition monitoring unit CMU generates and outputs a component-specific fault information FI together with an identification IDC of the affected component. The fault information FI and the identification IDC are transferred from the condition monitoring unit CMU to a display unit DU of the diagnostic device DD. The display unit DU then outputs the fault information FI and the identification IDC to a user of the diagnostic device DD.

The evaluation of the sensor signal SS by the diagnostic device DD or the condition monitoring unit CMU is explained in further detail below using a drive current of the point machine PM as sensor signal SS. It should be noted, however, that the embodiment described below is not constrained to using a drive current. Other sensor signals could be evaluated in the same or in an analog manner.

Figure 2:
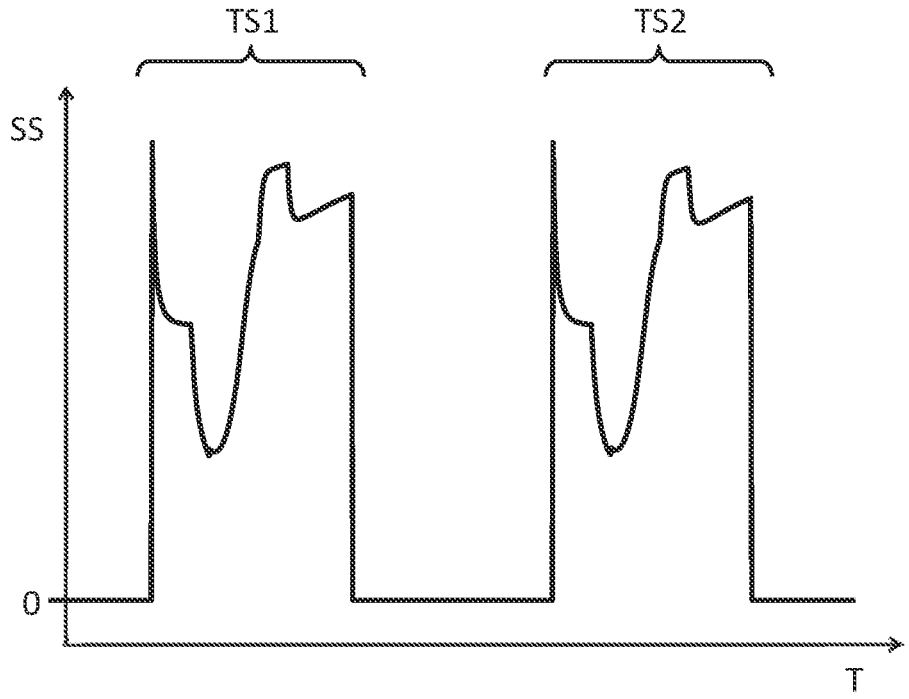
FIG. 2 shows a course of a sensor signal of the point machine.

FIG. 2 shows a typical course of a drive current SS of the point machine PM in schematic representation. The drive current SS is plotted against a time axis T. The course of the drive current SS exhibits two significant time series TS1 and TS2, which are the result of two specific actuations of the point machine PM. The first time series TS1 shows exemplary a resulting drive current when the railroad switch SW is moved to the left and the second time series TS2 shows exemplary a resulting drive current when the railroad switch SW is moved back to the right. As long as the railroad switch SW and the point machine PM work flawlessly both time series TS1 and TS2 are usually very similar. If a failure or damage occurs, the time series TS1 and TS2 will likely differ among them or compared to previous or historic time series.

According to the present embodiment, the time series TS1 and TS2 are consecutive time series of the sensor signal SS. Alternatively, the first time series TS1 may be picked from a historic operation period of the point machine PM or from a data base with time series of reference operations.

Because a fault or a degradation of the railroad switch SW or the point machine PM will usually change the course of the sensor signal SS, a health condition of the railroad switch SW or the point machine PM can be quantitatively evaluated by comparing a current, second time series TS2 with a previous time series TS1. An exemplary comparison process is described in further detail below.

Initially, the course of the drive current SS may be tested for signs that could indicate abnormal operation to such extent that immediate maintenance is required. Such tests may check a proper initialization and termination of an operation, a correct motor start-up, and a relative similarity of a current time series TS2 to a previous time series TS1. As the point machine PM is ideally expected to degrade smoothly over time, consecutive time series, here TS1 and TS2, of the sensor signal SS are expected to be similar both in shape and values. If, however, environmental contamination or sudden degradation, e.g., caused by a crack, occurs, a current time series TS2, will likely show an uncharacteristic dissimilarity to a time series TS1 of a previous operation.

If the above tests indicate a slow degradation, the inventive method allows to quantify the degradation and to identify or localize a degrading component by determining a similarity of different time series. If a current time series TS2 is compared with a reference time series TS1 measured in factory, a progressive dissimilarity of the course of the sensor signal SS due to a smooth degrading of the point machine PM or the railroad switch SW can be detected and quantified. Furthermore, a time series TS1 resulting from an operation of the point machine PM moving to the left may be compared with a time series TS2 resulting from a movement in the opposite direction. It turns out that from the above comparisons, one can estimate and localize an occurring friction. From that, a degrading component may be identified, and the degradation may be quantified. A correlation between a similarity of a current sensor signal to a reference sensor signal and a sum of squared wing frictions appears to be essentially linear. Moreover, a correlation between a wing friction difference and a similarity of two mirrored operations appears to be essentially quadratic. Using these two estimates, a system of equations can be constructed and solved.

Below, different methods for quantifying a similarity between different time series are described in further detail.

According to a first method for quantifying a similarity between different time series, a so-called dynamic time warping method—often abbreviated as DTW—is used. In an embodiment, a standard DTW method may be adapted to the needs of embodiments of the present invention.

The DTW method measures a similarity between two time series which may vary in speed and scale. For this purpose, points from a first time series are mapped to points from a second time series. This may be achieved by minimizing a sum of absolute distances for each matched pair of points. The points may be identified by their respective index within a respective time series.

The matching process may adhere to the following constrains:

- Every index from the first time series should be matched with one or more indices from the other sequence, and vice versa.
- The first index from the first time series should be matched with the first index from the other time series.
- The last index from the first time series should be matched with the last index from the other time series.
- The mapping of the indices from the first time series to indices from the second time series should be monotonically increasing and vice versa.

The above steps are designed to estimate the similarity of two time series, even in case of time shifting and/or scaling effects. In the framework of embodiments of the current invention, however, time shifting effects, e.g., operation delays, are indicators of improper operation of the railroad switch SW and/or the point machine PM.

Such shifting effects are clearly reflected in the resulting DTW mapping of the points. If the second time series is simply a scaled variant of the first time series, the mapping will be linear, i.e., the n-th point of the first time series will be mapped to the n-th point of the second time series. If shifting effects occur, however, the mapping will deviate from a linear course.

Figure 3:
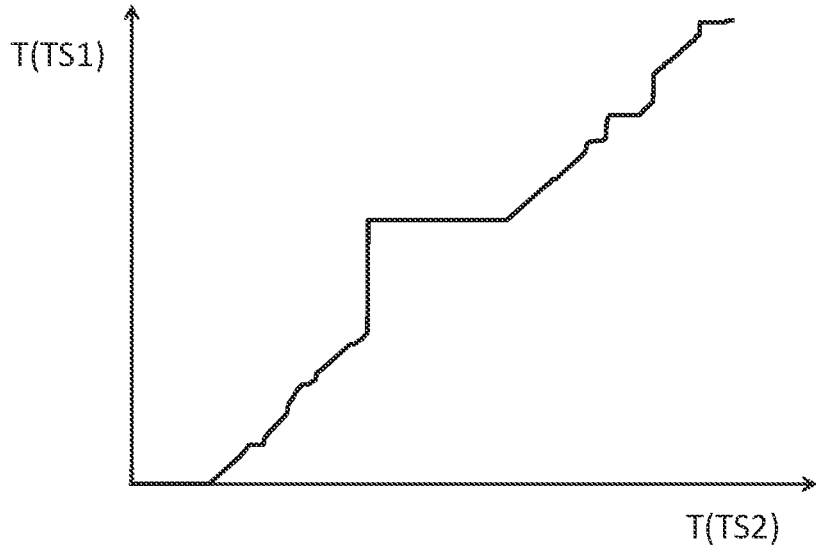
FIG. 3 shows a mapping of two time series of the sensor signal by a dynamic time warping method.

FIG. 3 visualizes a typical DTW mapping of two time series TS1 and TS2 when shifting effects are present. The graph denotes the allocation of time points T(TS1) of the first time series TS1 to corresponding time points T(TS2) of the second time series TS2. It should be noted that in order to illustrate the shifting effects, the times series TS1 and TS2 used for FIG. 3 are different from the times series shown in the other figures. The latter are much more similar than the former.

The graph shown in FIG. 3 obviously deviates from a linear course, thus indicating an improper operation. In order to quantify that deviation, the graph may be numerically compared to a linear balance line, and the deviation from that balance line may be used as a quantified measure of the similarity between the compared time series TS1 and TS2. This quantified measure may then be used as a quantified fault information.

Below, a second method for quantifying a similarity between different time series is described in further detail.

In many time series of sensor signals, there are specific event points that carry a higher information content than other points of the time series. Such event points particularly occur when operational conditions of a respective component change. Therefore, such event points can often be specifically used to determine a health condition of a respective component involved.

So, the task is to find those points of a time series that specifically carry information about a specific component. In the past, such event points have been identified by experienced engineers with a deep knowledge of the process. Embodiments of the present invention, however, allow to automatically find relevant event points and to determine to which components they correspond.

Figure 4:
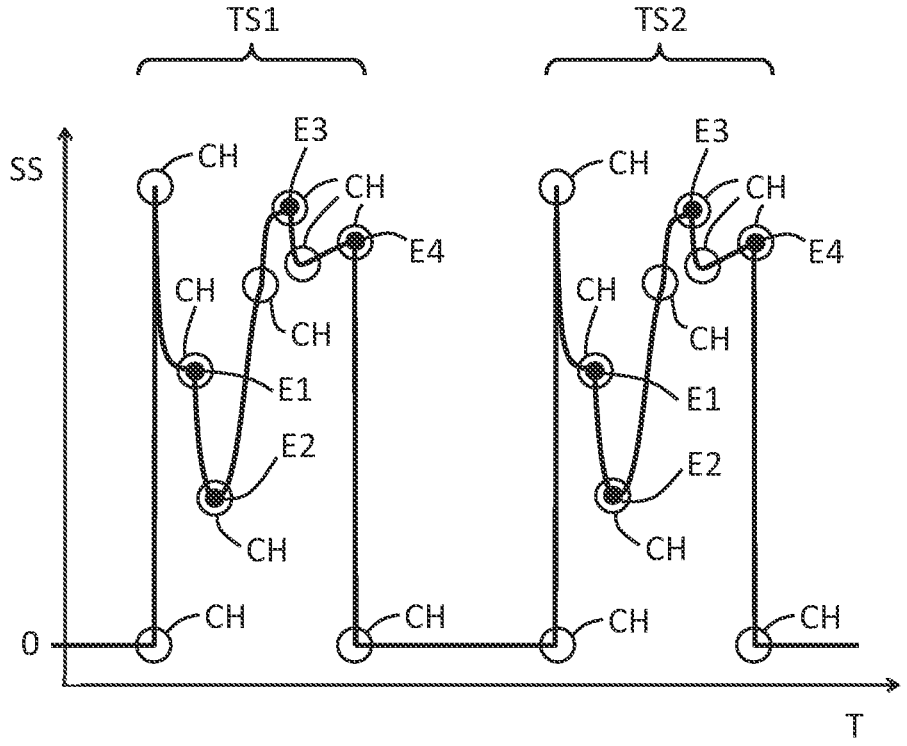
FIG. 4 shows the course of the sensor signal with identified event points.

FIG. 4 shows the course of the sensor signal SS with identified component-specific event points E1-E4 in schematic representation. For the sake of clarity only event points E1-E4 specific for the component C1 are explicitly depicted. In the exemplary embodiment illustrated by this figure, the component C1 is the right wing of the railroad switch SW.

A first step to identify the event points E1-E4 is to detect changes CH in the time series TS1 and TS2, indicating changes of the operational conditions of the components. Such changes CH usually separate different phases of a switch operation, which are often dominated by phase-specific components.

The changes CH are detected by determining a local curvature of the sensor signal SS in the time series TS1 and TS2. A change CH may then be recognized if the local curvature exceeds a given value. In particular, a change CH may be recognized if the following numerical condition for the time derivatives of the sensor signal SS is fulfilled:

$$|\partial SS(i)/\partial T-\partial SS(i-1)/\partial T>=|\partial SS(i-1)/\partial T|+TH$$

with i denoting a time index and TH denoting a given threshold value. The changes CH may then be allocated to those indices i which fulfill the above condition.

Once the changes CH have been identified, their points have to be allocated to specific components.

For this purpose, the simulation SIM may be used to simulate component operations and component-individual patterns of the sensor signal SS. With that, correlations between component-individual patterns and the points of the changes CH can be calculated. In particular, a random trees method may be used to determine a significance of a respective change CH for a characteristic behavior, e.g., a friction, of a respective component. It turns out that this method allows a reliable identification of component-specific event points from the changes CH, in particular for both wings and the shift plate of the railroad switch SW.

In the specific curve shown in FIG. 4 the characteristic event points E1-E4 for the right wing C1 are the valleys E1, E2 of the first half of the time series TS1 and TS2 and the peaks E3, E4 of the second half.

By using only component-specific event points instead of a whole time series, it can be avoided that shifting effects cause a time point to correspond to different operational events, thus blurring a reliable component identification.

Figure 5:
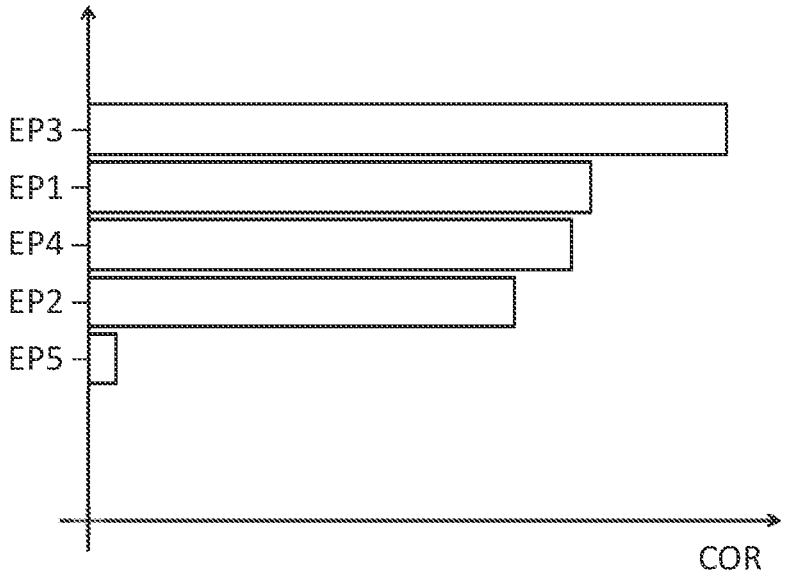
FIG. 5 shows a histogram of correlations between event points and component operations.

FIG. 5 shows a histogram of calculated correlations COR between time points E1-E5 of the sensor signal SS and specific component operations. For the sake of clarity only correlations COR with operations of the component C1, here the right wing, are depicted. The calculated correlation COR is a measure for a significance of a respective time point E1-E5 for operations of the component C1. The time points E1-E5 of the histogram are sorted by increasing correlation COR.

It appears that the time points E3, E1, E4, and E2 show a high linear or polynomial correlation COR to a friction of the right wing C1. Hence, these time points are allocated to the component C1 and are used as component-specific event points E1-E4 in the further process. The time point E5, on the other hand, shows only little correlation COR to an operation of the right wing C1 and is, therefore, discarded.

Once the relevant event points E1-E4 have been determined, it is relatively simple to determine a quantitative, component-specific measure for a health condition of a specific component. To achieve this, the event points E1-E4 for a respective component C1, here the right wing of the railroad switch SW, are identified on the time series TS1 and TS2. Then, the sensor signal SS at the event point E1 in the time series TS1 is compared with the sensor signal SS at the event point E1 in the time series TS2. Accordingly, the sensor signal SS at the respective event point E2, E3, or E4 in the time series TS1 is compared with the sensor signal SS at the corresponding event point E2, E3, or E4, respectively, in the time series TS2. The respective comparison comprises a calculation of a mismatch, in particular a difference between the compared values of the sensor signal SS. The calculated mismatches are a quantitative measure for a degradation, a fault, a damage, a health condition, a root cause, and/or a remaining useful lifetime of a specific component.

From the mismatches a quantified and component-specific fault information FI can be derived and output together with an identification IDC of the component concerned.

The quantified and component-specific fault information FI can be particularly used to:

Identify whether the railroad switch SW or the point machine PM is faulty or not, Quantitatively or qualitatively assess a severity of a damage, Localize a faulty or damaged component, Estimate a remaining useful lifetime, Infer a root cause of a failure, Distinguish between a gradual degradation and a sudden failure, Alert a maintenance engineer, and/or Suggest supporting actions to resolve a problem.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements.

The invention claimed is:

1. A computer-implemented method for diagnosing a railroad switch with a point machine, the method comprising:

a) receiving a first time series and a second time series of a sensor signal of the point machine, the sensor signal being sensitive to an operation of the point machine;

b) detecting changes in the first time series and the second time series indicating changes of operational conditions of the point machine;

c) allocating an event point of a respective change in the first time series and in the second time series to a respective component of the railroad switch or of the point machine based on a simulation modelling the respective component; and d) for a respective component:

identifying event points allocated to the respective component;

comparing the sensor signal at a first identified event point in the first time series with the sensor signal at a second identified event point in the second time series; and depending on the comparing, outputting a component-specific fault information and an identification of the respective component wherein, at least one of:

(1) a mismatch between the sensor signal at the first identified event point and the sensor signal at the second identified event point is quantified, and from the quantified mismatch a quantified fault information is derived and output; and (2) a dynamic time warping method is used to quantify a measure of a similarity between the first time series and the second time series, and from the quantified similarity measure a quantified fault in-formation is derived and output, wherein at least one of the quantified mismatch and the quantified similarity is compared with a predetermined threshold to determine whether the respective component is damaged or not.

2. The method as claimed in claim 1, wherein the sensor signal specifies a drive current or a power consumption of the point machine.

3. The method as claimed in claim 1, wherein by the simulation an operation of a respective component and a corresponding time series of the sensor signal are simulated, for different components the corresponding time series are searched for component-individual patterns, and from a respective component-individual pattern a characteristic event point is selected and allocated to the respective component.

4. The method as claimed in claim 1, wherein the mismatch between the sensor signal at the first identified event point and the sensor signal at the second identified event point is quantified, and from the quantified mismatch the quantified fault information is derived and output, wherein the quantified mismatch is compared with the predetermined threshold to determine whether the respective component is damaged or not.

5. The method as claimed in claim 4, wherein:

the quantified mismatch is compared with a second predetermined threshold to determine whether a degradation of the respective component is gradual or sudden; and/or from the quantified mismatch a severity of a damage, a root cause of the damage, a failure mode, a degradation, and/or a remaining useful lifetime of the respective component is determined.

6. The method as claimed in claim 1, wherein the dynamic time warping method is used to quantify a measure of a similarity between the first time series and the second time series; and from the quantified similarity measure the quantified fault in-formation is derived and output, wherein the quantified similarity is compared with the predetermined threshold to determine whether the respective component is damaged or not.

7. The method as claimed in claim 6, wherein:

the quantified similarity measure is compared with a second predetermined threshold to determine whether a degradation of the railroad switch or the point machine is gradual or sudden; and/or from the quantified similarity measure a severity of a damage, a root cause of the damage, a failure mode, a degradation, and/or a remaining useful lifetime of the railroad switch or the point machine is determined.

8. The method as claimed in claim 1, wherein the second time series is regularly taken from a current operation of the point machine; and the first time series is taken from a fault-free and/or historic operation period of the point machine, and/or from an operation immediately preceding the current operation.

9. A device for diagnosing a railroad switch with a point machine, configured to perform the a computer-implemented method for diagnosing the railroad switch with the point machine, the method comprising:

a) receiving a first time series and a second time series of a sensor signal of the point machine, the sensor signal being sensitive to an operation of the point machine;

b) detecting changes in the first time series and the second time series indicating changes of operational conditions of the point machine;

c) allocating an event point of a respective change in the first time series and in the second time series to a respective component of the railroad switch or of the point machine based on a simulation modelling the respective component; and d) for a respective component:

identifying event points allocated to the respective component;

comparing the sensor signal at a first identified event point in the first time series with the sensor signal at a second identified event point in the second time series; and depending on the comparing, outputting a component-specific fault information and an identification of the respective component wherein, at least one of:

(1) a mismatch between the sensor signal at the first identified event point and the sensor signal at the second identified event point is quantified, and from the quantified mismatch a quantified fault information is derived and output; and (2) a dynamic time warping method is used to quantify a measure of a similarity between the first time series and the second time series, and from the quantified similarity measure a quantified fault in-formation is derived and output, wherein at least one of the quantified mismatch and the quantified similarity is compared with a predetermined threshold to determine whether the respective component is damaged or not.

10. A computer program product, comprising a computer readable hardware storage device having computer readable program code stored therein, said program code executable by a processor of a computer system to implement a computer-implemented method for diagnosing the railroad switch with the point machine, the method comprising:

a) receiving a first time series and a second time series of a sensor signal of the point machine, the sensor signal being sensitive to an operation of the point machine;

b) detecting changes in the first time series and the second time series indicating changes of operational conditions of the point machine;

c) allocating an event point of a respective change in the first time series and in the second time series to a respective component of the railroad switch or of the point machine based on a simulation modelling the respective component; and d) for a respective component:

identifying event points allocated to the respective component;

comparing the sensor signal at a first identified event point in the first time series with the sensor signal at a second identified event point in the second time series; and depending on the comparing, outputting a component-specific fault information and an identification of the respective component wherein, at least one of:

(1) a mismatch between the sensor signal at the first identified event point and the sensor signal at the second identified event point is quantified, and from the quantified mismatch a quantified fault information is derived and output; and (2) a dynamic time warping method is used to quantify a measure of a similarity between the first time series and the second time series, and from the quantified similarity measure a quantified fault in-formation is derived and output, wherein at least one of the quantified mismatch and the quantified similarity is compared with a predetermined threshold to determine whether the respective component is damaged or not.

11. A non-transitory computer readable storage medium storing a computer program product comprising a computer readable hardware storage device having computer readable program code stored therein, said program code executable by a processor of a computer system to implement a computer-implemented method for diagnosing the railroad switch with the point machine, the method comprising:

a) receiving a first time series and a second time series of a sensor signal of the point machine, the sensor signal being sensitive to an operation of the point machine;

b) detecting changes in the first time series and the second time series indicating changes of operational conditions of the point machine;

c) allocating an event point of a respective change in the first time series and in the second time series to a respective component of the railroad switch or of the point machine based on a simulation modelling the respective component; and d) for a respective component:

identifying event points allocated to the respective component;

comparing the sensor signal at a first identified event point in the first time series with the sensor signal at a second identified event point in the second time series; and depending on the comparing, outputting a component-specific fault information and an identification of the respective component wherein, at least one of:

(1) a mismatch between the sensor signal at the first identified event point and the sensor signal at the second identified event point is quantified, and from the quantified mismatch a quantified fault information is derived and output; and (2) a dynamic time warping method is used to quantify a measure of a similarity between the first time series and the second time series, and from the quantified similarity measure a quantified fault in-formation is derived and output, wherein at least one of the quantified mismatch and the quantified similarity is compared with a predetermined threshold to determine whether the respective component is damaged or not.

* * * * *